US005806947A

United States Patent [19]

Meisner et al.

[11] Patent Number: 5,806,947

[45] Date of Patent: Sep. 15, 1998

[54] FOLDABLE WORKBENCH INCLUDING UNIVERSAL TRAY

[75] Inventors: Edward H. Meisner, Short Hills, N.Y.; Keith C. Kristiansen, Stratford, Conn.; John E. Kiely, Morristown, N.J.; Murray Hunter, Smiths Falls, Canada

[73] Assignee: Black & Decker Inc., Newark, Del.

[21] Appl. No.: 695,094

[22] Filed: Aug. 8, 1996

[51] Int. Cl.[6] ..... A47B 97/08

[52] U.S. Cl. ..... 312/280; 269/139; 269/901; 269/16; 292/87; 211/70.6; 312/334.46; 312/310; 312/351.8

[58] Field of Search ..... 269/139, 901, 269/16; 108/115, 90, 92; 292/87, 128; 211/70.6, 60.1; 312/332.2, 334.46, 244, 237, 258, 310, 351.8, 351.6, 280

[56] References Cited

U.S. PATENT DOCUMENTS

| | | | |
|---|---|---|---|
| D. 347,155 | 5/1994 | Schlack et al. . | |
| 686,271 | 11/1901 | Dillenbech et al. . | |
| 1,323,915 | 12/1919 | Schmitt . | |
| 1,373,526 | 4/1921 | Price et al. . | |
| 1,427,777 | 9/1922 | Blowers | 269/16 |
| 2,637,358 | 5/1953 | Larson . | |
| 3,615,087 | 10/1971 | Hickman . | |
| 3,643,935 | 2/1972 | Bell . | |
| 3,841,619 | 10/1974 | Hickman . | |
| 3,851,756 | 12/1974 | Brown . | |
| 3,923,347 | 12/1975 | Dean | 312/334.46 X |
| 4,076,229 | 2/1978 | Hickman . | |
| 4,122,956 | 10/1978 | Hargrove . | |
| 4,154,435 | 5/1979 | Alessio . | |
| 4,155,386 | 5/1979 | Alessio | 269/901 X |
| 4,159,821 | 7/1979 | Hickman | 269/139 |
| 4,239,195 | 12/1980 | Oltman et al. . | |
| 4,276,955 | 7/1981 | Hickman . | |
| 4,278,243 | 7/1981 | Alessio . | |
| 4,291,869 | 9/1981 | Hickman . | |
| 4,475,727 | 10/1984 | Goulter . | |
| 4,483,524 | 11/1984 | Basten et al. | 269/501 X |
| 4,527,786 | 7/1985 | Hsu . | |
| 4,542,924 | 9/1985 | Brown et al. . | |
| 4,555,099 | 11/1985 | Hilton . | |
| 4,647,028 | 3/1987 | Yang . | |
| 4,730,731 | 3/1988 | Allison . | |
| 4,757,849 | 7/1988 | Morris . | |
| 4,874,025 | 10/1989 | Cleveland . | |
| 4,909,491 | 3/1990 | Cheng . | |
| 4,925,041 | 5/1990 | Pehr . | |
| 4,985,962 | 1/1991 | Weber . | |
| 5,005,710 | 4/1991 | Hofer | 211/70.6 |
| 5,065,989 | 11/1991 | Ho . | |

(List continued on next page.)

FOREIGN PATENT DOCUMENTS

| | | |
|---|---|---|
| 2286936 | 4/1976 | France . |
| 2655031 | 6/1978 | Germany . |
| 8702845 | 11/1987 | Netherlands . |
| 1578244 | 11/1980 | United Kingdom . |
| 2123321 | 2/1984 | United Kingdom . |
| 2164599 | 3/1986 | United Kingdom . |
| 2233885 | 1/1991 | United Kingdom . |
| 2267674 | 12/1993 | United Kingdom . |

*Primary Examiner*—Peter M. Cuomo
*Assistant Examiner*—Stephen Vu
*Attorney, Agent, or Firm*—Harness, Dickey & Pierce, P.L.C.

[57] ABSTRACT

A foldable workbench includes a tray assembly which is supported by the support structure of the workbench. The tray assembly is releasably secured to a rear cross member of the support structure and rests against a front cross member. As the foldable workbench is moved between its open and closed position, the tray assembly pivots on the rear cross member such that is does not interfere with the folding of the workbench. The tray assembly includes a housing which is the member which is pivotably secured to the workbench and a drawer which is slidably received within the housing. The drawer includes an integrally formed latch which releasably locks the drawer in a closed position.

7 Claims, 5 Drawing Sheets

U.S. PATENT DOCUMENTS 5,067,535 11/1991 Wolff .
5,100,015 3/1992 Vanderstuyf .
5,121,952 6/1992 Jason .
5,135,036 8/1992 Caron .
5,158,329 10/1992 Schlack .
5,190,169 3/1993 Sincock ..... 211/60.1
5,213,913 5/1993 Anthony, III et al. .
5,350,071 9/1994 Pond ..... 211/70.6
5,350,229 9/1994 Smed ..... 312/333 X
5,382,009 1/1995 Mertz et al. ..... 269/16

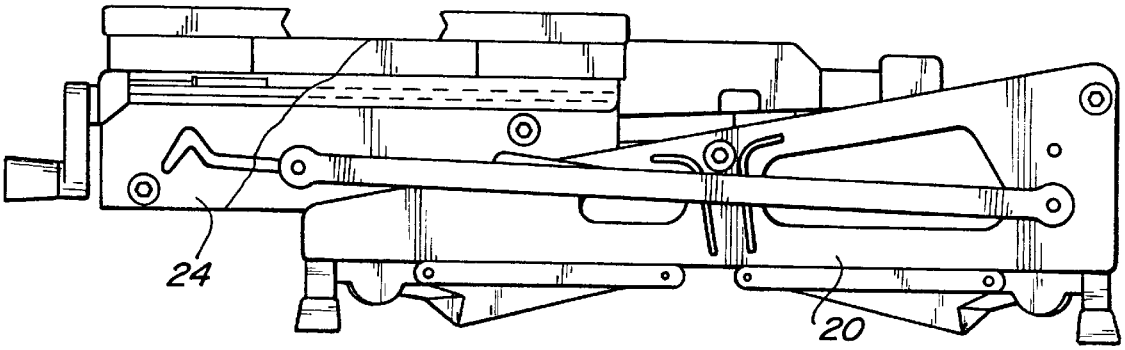
Fig - 3
Fig - 4
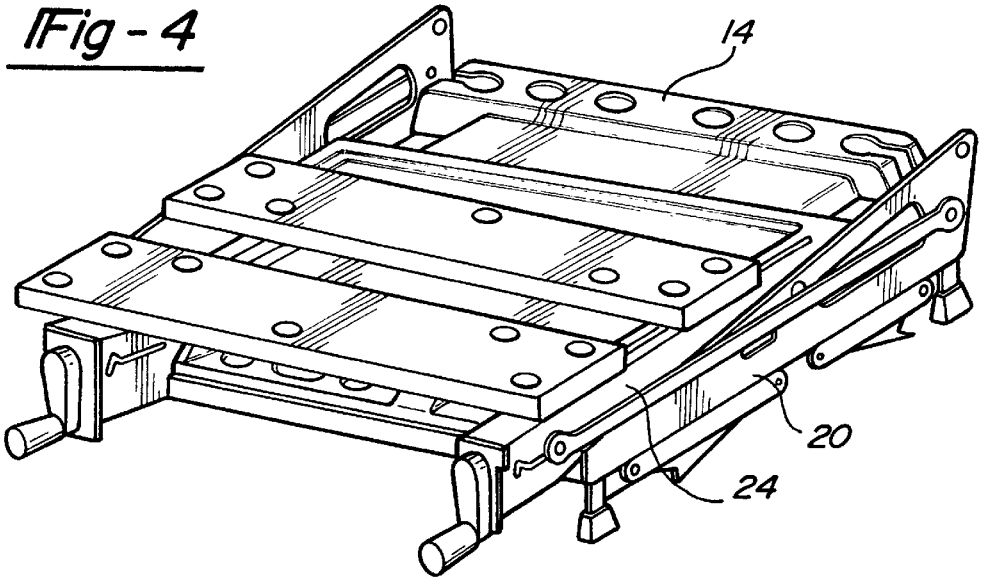

FOLDABLE WORKBENCH INCLUDING UNIVERSAL TRAY

FIELD OF THE INVENTION

The present invention relates to foldable workbenches. More particularly, the present invention relates to a foldable workbench which incorporates a universal storage tray and drawer which can be assembled onto a workbench and once assembled is collapsible with the foldable workbench.

BACKGROUND OF THE INVENTION

Compact, inexpensive workbenches, of which the well-known WORKMATE™ workbench is perhaps the best example, have been quite popular with home handymen and with some tradesmen. The WORKMATE™ workbench can quickly be manipulated from its collapsed storage position into its operating position for use in a wide variety of situations including support of work pieces for sawing, drilling, hammering, painting, etc. The popularity of the WORKMATE™ workbench has spawned a number of devices for use with the WORKMATE™ workbench in order to accommodate it to specific tasks and to increase the versatility of the WORKMATE™ workbench.

When using the WORKMATE™ workbench, handymen and tradesmen have had to suffer some inconvenience when the need arose to store various small components, such as loose nuts and bolts, when the need arose to store various small tools and when the need arose to store the clamping pegs associated with the WORKMATE™ workbench.

Accordingly what is needed is an apparatus which works in conjunction with a workbench, preferably a WORKMATE™ workbench, to provide the temporary storage of the various components encountered when utilizing the workbench for a specific project.

SUMMARY OF THE INVENTION

The present invention provides a universal tray and drawer which operates to store loose articles, small tools and the clamping pegs associated with the WORKMATE™ workbench. The universal tray is designed to be pivotably mounted to a support rail of the WORKMATE™ workbench such that it remains mounted to the WORKMATE™ workbench as it moves between its open position and its collapsed position.

In accordance with the present invention, the universal tray comprises a rectangular box shaped housing and a drawer slidably disposed within the housing. The drawer includes a latch which is designed such that when the drawer is being closed, a tab flexes over and past a rib on the housing and then engages securely behind the rib to secure the drawer in its closed position. The drawer is opened by pushing down on a button area of the latch, disengaging the tab from behind the rib, thus allowing the drawer to be pulled open. The housing includes a cord wrap feature at the rear which defines four holes for storing tools or the clamping pegs of the WORKMATE™ workbench. The housing is pivotably attached to a support member on the WORKMATE™ workbench which allows the universal tray to pivot and remain secure while the WORKMATE™ workbench is in its closed position. The upper surface of the housing includes a plurality of shallow recesses covering most of the surface area of the top of the unit to provide an area to set small parts or fasteners without having them roll off.

The drawer is slidably received within the housing and defines the latch for securing the drawer in its closed position. The front of the drawer defines the latch and a plurality of apertures for holding tools such as screwdrivers, pliers, etc.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 3 is a side view of the workbench assembly of FIG. 1 shown in the closed position;

FIG. 4 is a front perspective view of the universal tray shown in FIG. 1 shown in the closed position;

DETAILED DESCRIPTION OF THE PREFERRED EMBODIMENT

Figure 1:
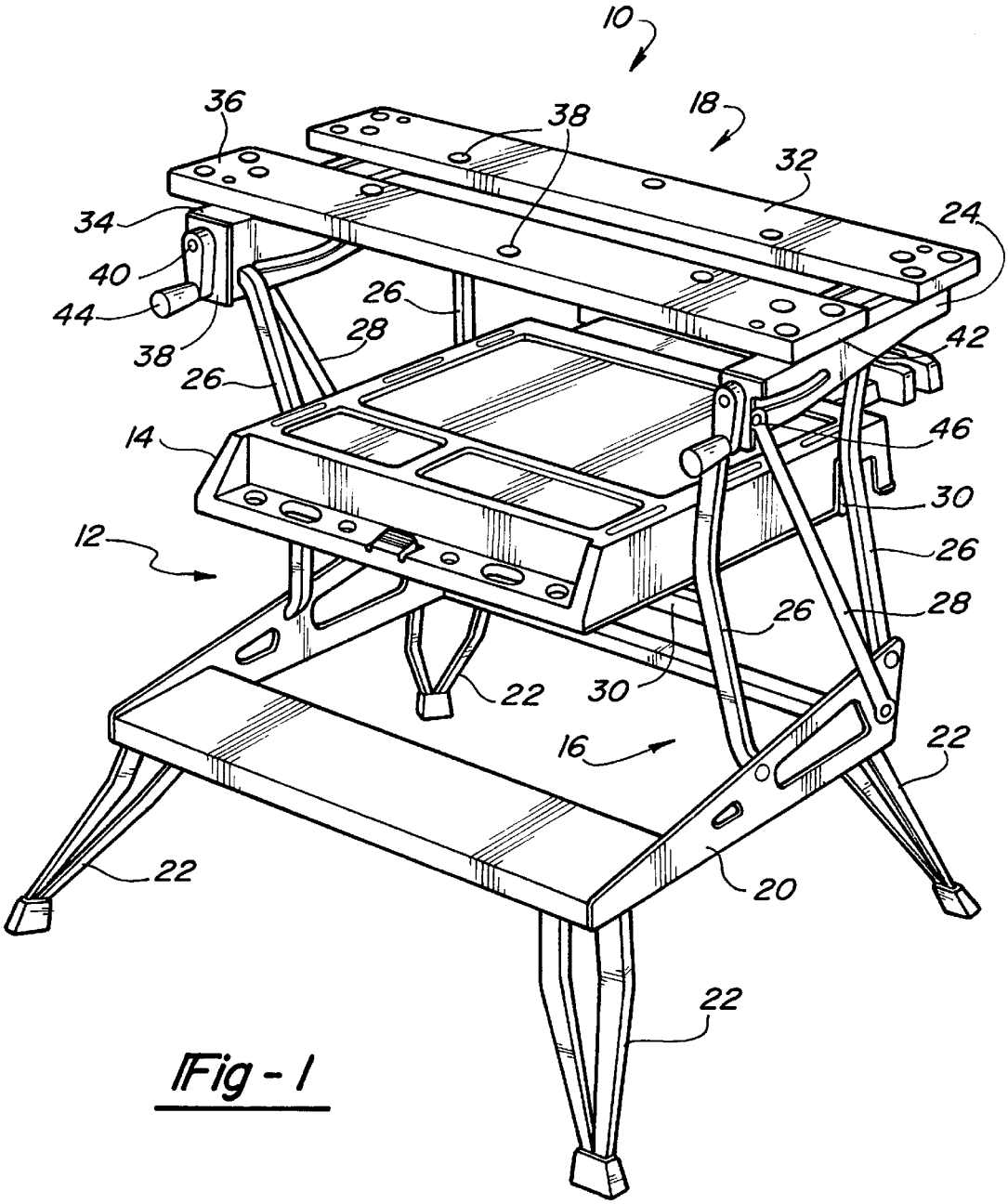
FIG. 1 is a front perspective view of a WORKMATE™ workbench incorporating a universal tray in accordance with the present invention.

Referring now to the drawings in which like reference numerals designate like or corresponding parts throughout the several views, there is shown in FIGS. 1 through 4 a workbench with a universal tray assembly in accordance with the present invention which is designated generally by the reference numeral 10. Workbench assembly 10 comprises a workbench 12 and a universal tray 14.

Workbench 12 comprises a collapsible frame 16 and a table top 18. Frame 16 comprises a lower frame 20, a plurality of legs 22, an upper frame 24, a plurality of support members 26 and a pair of angled cross supports 28. Legs 22 are each pivotably secured to lower frame 20 such that they are movable between an open position as shown in FIG. 1 and a closed position as shown in FIG. 3. Support members 26 extend between lower frame 20 and upper frame 24 and are pivotably secured to each of them. A horizontal support member 30 extends between the front pair of support members 26 and between the rear pair of support members 26 to provide stability to workbench assembly 10. Support members 30 are utilized to support universal tray 14 as will be described later herein. Angled support members 28 also extend between lower frame 20 and upper frame 24 and are also pivotably secured to each of them. In addition, angled support members 28 extend between the opposing side pairs of support members 26. Each angled support member 28 extends between the lower end of a respective rear support member 26 to the upper end of a respective front support member 26 to provide support to assembly 10.

Table top 18 comprises a stationary jaw 32, a pair of rack assemblies 34 and a movable jaw 36. Stationary jaw 32 is a generally rectangular plate like member which is fixedly secured to upper frame 24. Stationary jaw 32 defines a plurality of holes 38 each of which slidingly accepts a swivelable clamping peg (not shown) to increase the versatility of assembly 10. The pair of rack assemblies 34 are each comprised of a housing 39, a threaded rod 40 and a nut 42. Each housing 38 is fixedly secured to upper frame 24 at opposite sides of upper frame 24. Threaded rod 40 is rotatably received within housing 39 such that rotation of threaded rod 40 causes longitudinal movement of nut 42 along rod 40 and thus upper frame 24. A knob 44 is provided at the front of the table top 18 to facilitate the rotation of rod 40. Movable jaw 36 is also a generally rectangular plate like member which is pivotably secured to each nut 42. Movable jaw 36 also includes a plurality of holes 38 each of which slidingly accepts a swivelable clamping peg to increase the versatility of assembly 10. The pivotable attachment between movable jaw 36 and each nut 42 allows jaw 36 to pivot with respect to each nut 42. This pivotable movement allows each knob 44 to rotate independently to each other in order to permit the angular relationship between stationary jaw 32 and movable jaw 36 to be changed. Thus, when both knobs 44 are rotated simultaneously and movable jaw 36 is parallel to stationary jaw 32, the rotation of knobs 44 will cause movable jaw 36 to move towards or away from stationary jaw 32 while still maintaining its parallelism with stationary jaw 32. When the shape of an object being clamped requires movable jaw 36 to be located at an angular or non-parallel position with respect to stationary jaw 32, each knob 44 can be rotated a different amount and due to the pivotable connection between movable jaw 36 and nuts 42, movable jaw 36 will move to a non-parallel position with respect to stationary jaw 32. This non-parallel positioning of movable jaw 36 with respect to stationary jaw 32 is a feature that is well known in the art for the WORKMATE™ workbench.

Figure 2:
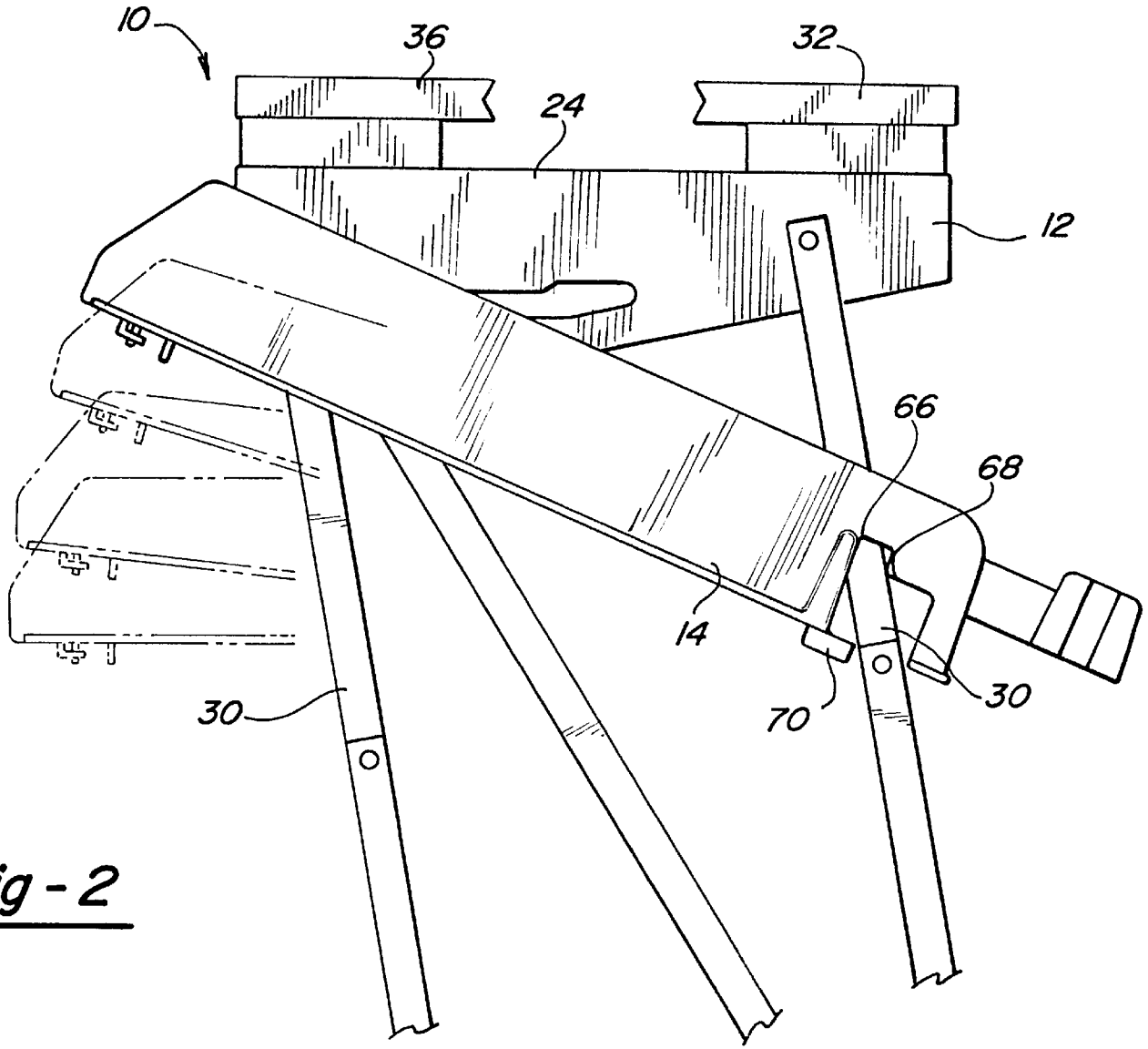
FIG. 2 is a partial side view of the workbench and tray shown in FIG. 1 illustrating the attachment of the tray to the workbench.

Workbench assembly 10 is movable between an open position as shown in FIGS. 1 and 2 and a closed position as shown in FIGS. 3 and 4. Workbench assembly 10 is collapsed from its open position (FIG. 1) by releasing a latch 46 on each angled cross member 28 which locks each cross member 28 to upper frame 24. Once released, cross member 28 and support members 26 can pivot with respect to frames 20 and 24 and move to the closed position as shown in FIG. 3. During this collapsing of workbench assembly 10, universal tray 14 pivots around and remains in engagement with the rear horizontal support member 30. When workbench assembly 10 is in its collapsed position, universal tray 14 becomes sandwiched between lower frame 20 and jaws 32 and 36 thus permitting the opening and closing of workbench assembly 10 without interference.

Referring now to FIGS. 5 through 8, universal tray 14 comprises a housing 50 and a drawer 52. Housing 50 is a generally box shaped member having an upper panel 54, a pair of side panels 56 and a rear panel 58. Upper panel 54 defines a plurality of recessed areas 60 which can be utilized to set small parts or fasteners on without having them roll off. Each side panel 56 defines a plurality of drawer supports 62 which slidingly receive and support drawer 52. Each side panel 56 also defines a stepped aperture 64 which is designed to mate with rear horizontal support member 30. Aperture 64 includes a front portion 66 which is slightly taller in height than the height of rear horizontal support member 30. Aperture 64 also includes a rear portion 68 which is designed to be smaller in height than the height of rear horizontal support member 30. An L-shaped support member 70 is attached to each side panel 56 to provide support for housing 50 when it is assembled to workbench 12.

L-shaped member 70 extends along the front surface of portion 66 of aperture 64 and extends below portion 66 a distance generally equal to the width of portion 66. The assembly of tray 14 onto workbench 12 is accomplished by first inserting tray 14 into the area between upper frame 24 and horizontal support members 30 as shown in FIG. 2. Tray 14 is positioned over rear support member 30 and is angled such that support member 30 extends through the lower end of rear portion 68 of aperture 64 and into the upper end of front portion 66. Tray 14 is then pivoted downward such that it rests against the top of front horizontal member 30. This pivotal movement locks tray 14 to workbench 12 by trapping rear support member 30 in front portion 66 of aperture 64. Tray 14 is unable to move due to the stepped nature of aperture 64 and L-shaped member 70. L-shaped member 70 also prevents housing 50 from tilting when drawer 52 is opened. When drawer 52 is opened, the weight of the contents will have a tendency to rotate housing 50 about front horizontal support member 30. This rotating or tilting of housing 50 is resisted by L-shaped member 70.

When workbench assembly 10 is moved to its closed position, tray 14 is pivoted 90° on rear horizontal support member 30 such that member 30 is located along the lower opening of aperture 64. The lower opening of aperture 64, which is a combination of the widths of front and rear portions 66 and 68, respectively, is similar in dimension to the height of front portion 66. In this position, L-shaped member 70 again maintains the engagement between support member 30 and tray 14. Thus, aperture 64 in combination with L-shaped support member 70 allows for the simplified assembly of tray 14 with workbench 12 and once assembled, aperture 64 and member 70 maintain the engagement between tray 14 and workbench 12 as workbench 12 is moved between its open and closed positions.

Rear panel 58 closes the rear portion of housing 50 and defines a T-shaped member 72 extending to the rear of housing 50. T-shaped member 72 along with rear panel 58 defines a pair of openings 74 which provide room for the winding of an electrical cord, or other such cord, around the front portion of T-shaped member 72. The rear portion of T-shaped member 72 is provided with a key-hole shaped aperture 76 located at each end and a plurality of generally circular apertures 78 disposed between apertures 76. Apertures 78 are utilized for storing the plurality of clamping pegs of the WORKMATE™ workbench when they are not being utilized with jaws 32 or 36. In addition, apertures 78 can be utilized for holding tools if desired. Key-hole shaped apertures 76 are designed to allow the male and female ends of an electrical cord to be secured relative to T-shaped member 72. Thus when an electrical cord is to be wound around T-shaped member 72, one end is located within one of the two apertures 76 and the cord is wound around the front portion of member 72 within openings 74. Upon reaching the opposite end of the cord, it is inserted into the other of the two apertures 76. T-shaped member 72 and apertures 76 thus provide a storage feature for an electrical cord which stores the cord out of the way with respect to workbench 12 and secures the cord to tray 14 during the opening and closing of workbench assembly 10.

Drawer 52 is a box shaped component which defines a flange 80 extending the length of each side of drawer 52. Flanges 80 slidingly engage a respective plurality of drawer supports 62 located on a respective side panel 56. Thus drawer 52 is movable between an open position and a closed position with respect to housing 50 due to this sliding engagement.

Figure 5:
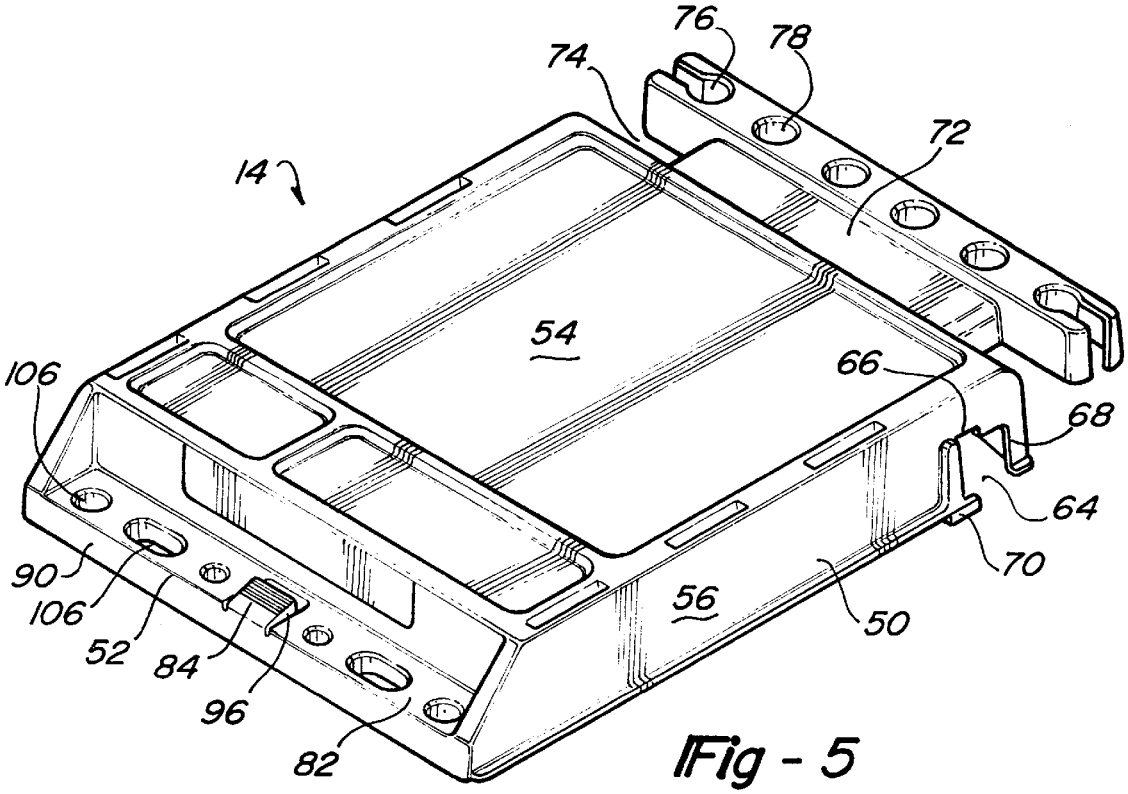
FIG. 5 is a front perspective view of the universal tray shown in FIG. 1 shown in the closed position.
Figure 7:
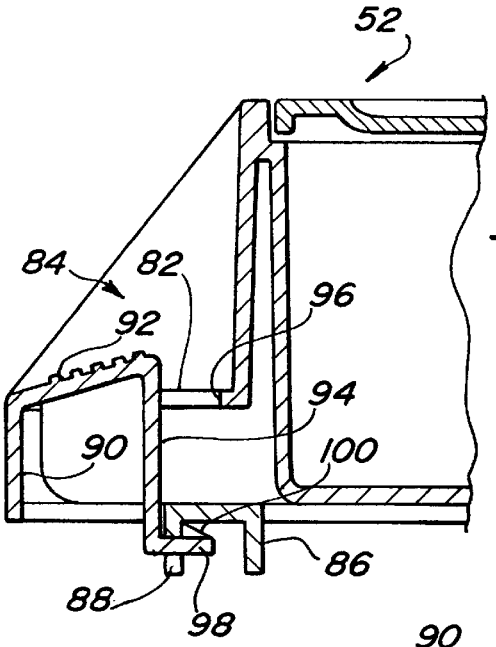
FIG. 7 is an enlarged cross-sectional view illustrating the latch according to the present invention, in its closed position.
Figure 8:
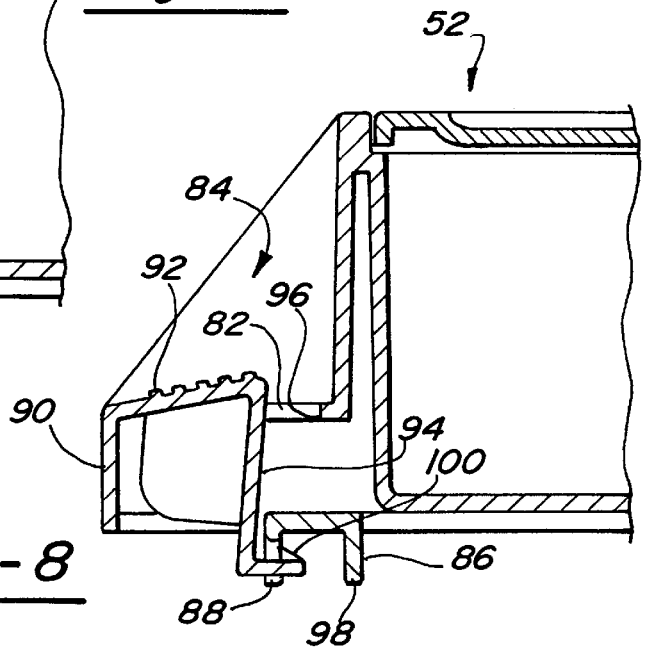
FIG. 8 is an enlarged cross-sectional view illustrating the latch according to the present invention, in its open position.

Referring now to FIGS. 5, 7 and 8, the front panel of drawer 52 defines a generally horizontal surface 82 which includes a retaining latch 84 for holding drawer 52 closed during opening, closing and the transporting of workbench assembly 10. Horizontal surface 82 also defines a plurality of apertures 106 which extend through surface 82 and are utilized to hold various tools such as screwdrivers, plier, etc. while working with workbench assembly 10.

Figure 6:
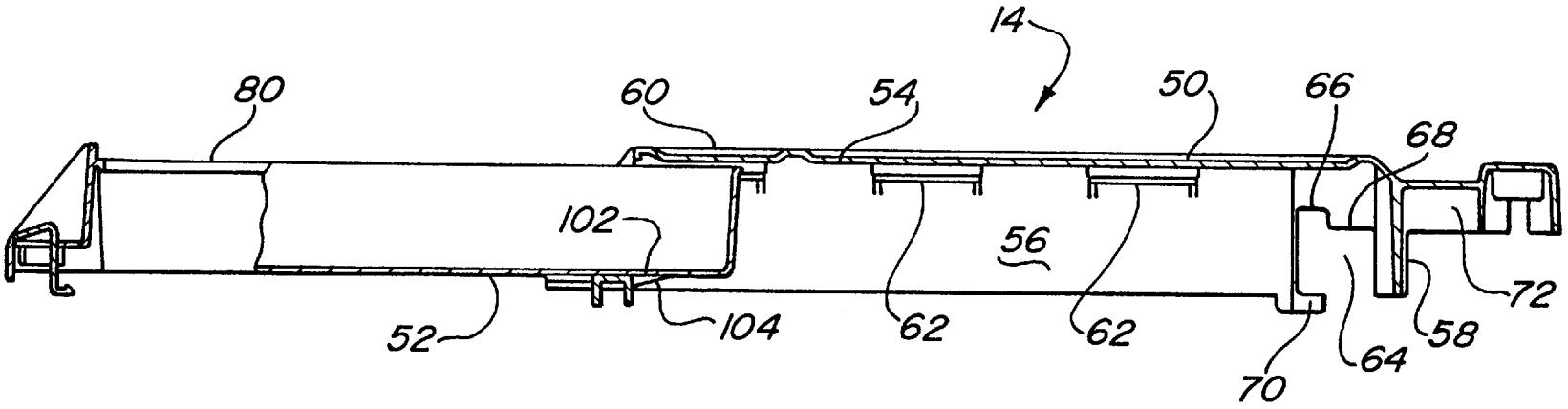
FIG. 6 is a side cross-sectional view of the universal tray shown in FIG. 1.

Latch 84 mates with a front cross member 86 which extends between opposing side panels 56 to provide support for housing 50. Cross member 86 defines a slot 88 which mates with latch 84. Latch 84 is a generally U-shaped member that is formed integrally with drawer 52. Latch 84 comprises a front wall 90, a top surface 92 and a latching arm 94. Front wall 90 extends across the entire front section of drawer 52. Top surface 92 extends from front wall 90 at an angle slightly greater than 90° above an opening 96 formed in surface 82 of drawer 52. Latching arm 94 extends from surface 92 in the same direction as and generally parallel with front wall 90. Arm 94 defines a lock 98 which extends generally perpendicular to arm 94 and includes a camming surface 100. When drawer 52 is in its closed position, as shown in FIG. 7, lock 98 extends through slot 88 in cross member 86 and locks behind cross member 86 due to the flexibility of wall 90 and surface 92. To open drawer 52, a load is applied to surface 92 by simply pushing on surface 92. This unlocks the drawer by elastically bending retaining latch 84 until lock 98 is free to pass through slot 88 defined by cross member 86, as shown in FIG. 8. Drawer 52 can now be slid open. A pair of drawer stops 102, as shown in FIG. 6, are integrally formed with the bottom of drawer 52. Stops 102 prohibit removal of drawer 52 from housing 50 by contacting cross member 86. When drawer 52 needs to be removed, cross member 86 can be flexed downward allowing stops 102 to pass over cross member 86. In a similar manner, the installation of drawer 52 into housing 50 is accomplished by having cross member 86 flex downward to permit stop 102 to pass over cross member 86. Stop 102 includes an angular surface 104 to aid in the installation of drawer 52. When closing drawer 52, camming surface 100 will act against cross member 86 to flex retaining latch 84 such that lock 98 will again pass through slot 88 beyond cross member 86 and lock drawer 52 in its closed position.

While the above detailed description describes the preferred embodiment of the present invention, it should be understood that the present invention is susceptible to modification, variation and alteration without deviating from the scope and fair meaning of the subjoined claims.

What is claimed is:

1. A foldable workbench comprising:

a work table;

a support structure for supporting said work table, said support structure including a front cross member and a rear cross member and being movable between an open condition and a folded condition; and a tray assembly having a first position where said tray assembly is releasably supported by said front and rear cross members of said support structure and a second position where said tray assembly is separated from said support structure, said tray assembly comprising:

a housing defining an aperture for releasably securing said housing to said rear cross member of said support structure when said tray assembly is in said first position, said housing being pivotably secured to said support structure by the engagement of said aperture with said rear cross member, said housing pivoting with respect to said support structure during movement between said open and said folded condition when said tray assembly is in said first position; and a drawer slidingly received within said housing, said drawer being movable between an open position and a closed position.

2. The foldable workbench according to claim 1 wherein, said drawer includes a latch, said latch releasably engaging said housing in order to lock said drawer in said closed position.

3. The foldable workbench according to claim 2 wherein, said latch is integrally formed with said drawer.

4. The foldable workbench according to claim 1 wherein, said housing includes a generally T-shaped member extending outwardly from one side of said housing.

5. The foldable workbench according to claim 4 wherein, said T-shaped member defines at least one aperture.

6. The foldable workbench according to claim 1 wherein, said drawer defines at least one aperture.

7. The foldable workbench according to claim 1 wherein, said housing defines at least one recessed area located on a top panel of said housing.

* * * * *